US009638154B2

(12) United States Patent
Gerstner

(10) Patent No.: US 9,638,154 B2
(45) Date of Patent: May 2, 2017

(54) COMMON RAIL FUEL PUMP CONTROL SYSTEM

(75) Inventor: Michael D. Gerstner, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 1232 days.

(21) Appl. No.: 13/170,403

(22) Filed: Jun. 28, 2011

(65) Prior Publication Data

US 2013/0000604 A1 Jan. 3, 2013

(51) Int. Cl.
*F02M 63/02* (2006.01)
*F02M 63/00* (2006.01)
*F04B 1/04* (2006.01)

(52) U.S. Cl.
CPC ..... *F02M 63/027* (2013.01); *F02M 63/005* (2013.01); *F02M 63/025* (2013.01); *F02M 63/0265* (2013.01); *F04B 1/0452* (2013.01); *F02M 2200/247* (2013.01)

(58) Field of Classification Search
CPC ..... F02M 2200/247; F02M 63/005; F02M 63/025; F02M 63/0265; F02M 63/027; F04B 1/0452
USPC ..... 123/447, 456, 458, 459, 506, 508, 510, 123/511, 512, 514, 198 D, 179.17; 701/103, 104
See application file for complete search history.

(56) References Cited

U.S. PATENT DOCUMENTS 4,284,101 A 8/1981 Weirich
4,699,171 A 10/1987 Sugden
5,361,742 A 11/1994 Briggs et al.
5,590,631 A 1/1997 Tuckey
5,609,138 A 3/1997 Mutschler
5,983,863 A * 11/1999 Cavanagh et al. ..... 123/447
6,131,548 A * 10/2000 Yano ..... 123/456
6,843,232 B2 1/2005 Keesee et al.
7,204,233 B2 4/2007 Nagai
7,331,361 B2 2/2008 Voss
7,455,049 B2 * 11/2008 Feinleib ..... 123/447
7,458,561 B2 12/2008 Oishi
7,575,221 B2 8/2009 Hartmann et al.
2007/0079810 A1 * 4/2007 Usui et al. ..... 123/467
2010/0282212 A1 11/2010 Shafer et al.

FOREIGN PATENT DOCUMENTS

DE 3840865 6/1990
JP 09303187 11/1997

* cited by examiner

*Primary Examiner* — Carlos A Rivera
*Assistant Examiner* — Carl Staubach
(74) *Attorney, Agent, or Firm* — Miller, Matthias & Hull

(57) ABSTRACT

A fuel pump manifold pressure control system may be effective to provide a compact and more effective fuel pump mechanism for compression ignition engines, such as diesel and some natural gas engines. The fuel pump manifold pressure control system includes a fuel pump manifold, at least one fuel injection accumulator adapted for supplying pressurized fuel to at least one fuel injector, a pressure control valve, a pressure sensor, and a pressure relief valve, all contained within a compact fuel pump housing. The pressure control valve and pressure sensor are each adapted for signal communication with electronic controller, and for fuel communication with the fuel pump manifold. The pressure relief valve is adapted for fuel communication with the fuel pump manifold. Each of the control valve, sensor, and relief valve are fixedly mounted to and internally contained within the housing.

20 Claims, 5 Drawing Sheets

COMMON RAIL FUEL PUMP CONTROL SYSTEM

TECHNICAL FIELD

The present disclosure generally relates to high pressure fuel pump structures, and particularly to common rail fuel pump control systems.

BACKGROUND

High-pressure fuel pump systems are used in a variety of motorized platforms, including those of trucks, buses, and automobiles, as well as off-road machines utilized in construction, mining, and agricultural fields. They are also utilized in marine as well as industrial applications, the latter including, by way of example, electric power generation and petroleum drilling rigs. Such pumps are generally mechanically driven via associated engines for delivering fuel under high pressure to fuel injectors and into individual cylinders of the engines through so-called common rail fuel systems.

Common rail fuel systems generally include fuel delivery components associated with a high-pressure variable delivery pumps. A variable delivery pump may be effective to deliver high-pressure fuel into a manifold that acts as a central accumulator for the high-pressure fuel prior to its delivery to individual injectors. The manifold thus dampens pressure fluctuations occurring from discreet high pressure pumping events. Typically, the fuel is sourced from a fuel tank by means of a low pressure fuel transfer pump to the variable delivery high-pressure fuel pump.

Apart from atmospheric emissions control purposes, the fuel is pressurized to facilitate the accurately timed and controlled delivery of discrete fuel amounts to the fuel injectors. As such, an electronic control system is generally employed to monitor and optimize system fuel pressure. The electronic control system operates the high-pressure pump as well as each of the electronically actuated fuel injectors to optimize fuel pressure and quantity, as well as timing of delivery, under a variety of engine operating conditions.

Normally, such systems include capabilities for avoiding over-pressurization of the fuel pump manifold and or rails, which can occur upon any number of operational, control, or component failures. Thus, there is a constant quest for improving overall efficiencies, reliabilities, and durabilities of common rail fuel systems.

One additional area for potential improvement relates to packaging of and/or installation of components within fuel pump housings. As such, there may be an opportunity for placement of pressure relief valves, pressure sensors, and pressure control valves into actual fuel pump housings, as opposed to the placement of one or more of such components outside of such housings. This effort may facilitate the use of more compact structures in the face of ever tightening space restrictions.

SUMMARY OF THE DISCLOSURE

In accordance with a first aspect of the disclosure, a fuel pump manifold pressure control system incorporates a housing that contains an entire plurality of pump components, including a pump manifold as well as a pressure control valve, a sensor, and a pressure relief valve.

In accordance with a second aspect of the disclosure, a fuel pump is mechanically driven by a cam shaft adapted to reciprocatingly drive fuel plunger pistons orthogonally with respect to the camshaft to create discrete pumping events, all contained within a housing that encompases the control valve, the sensor, and the pressure relief valve.

In accordance with a third aspect of the disclosure, a compression ignition engine incorporates a high-pressure fuel injection fuel pump system that provides limp home capabilities after an overpressure event has opened the pressure relief valve.

DETAILED DESCRIPTION

Figure 1:
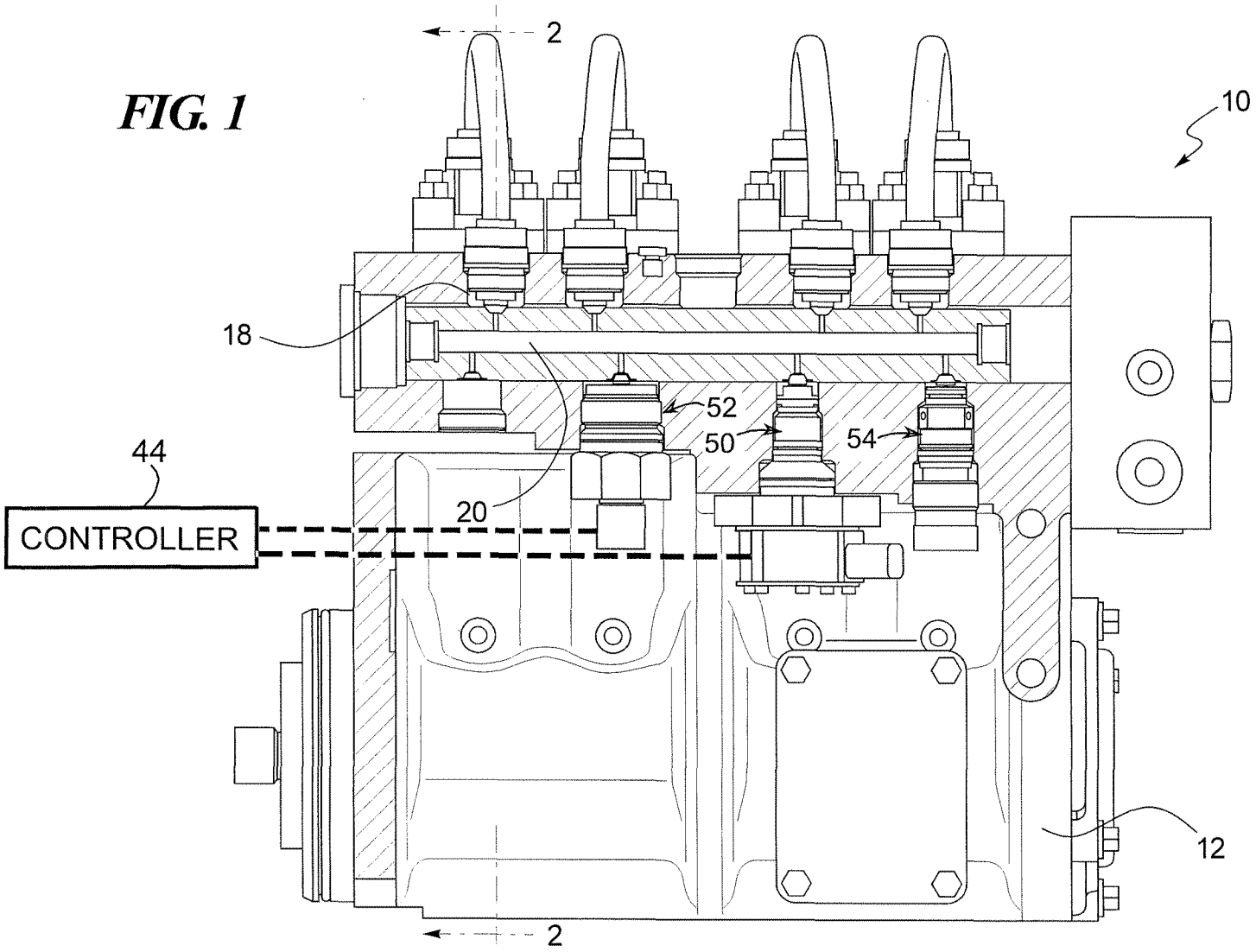
FIG. 1 is an elevational cross-sectional of a compact high-pressure fuel pump as disclosed, incorporating pumping elements, control valve, sensor and relief valve all within a single unitary housing.
Figure 2:
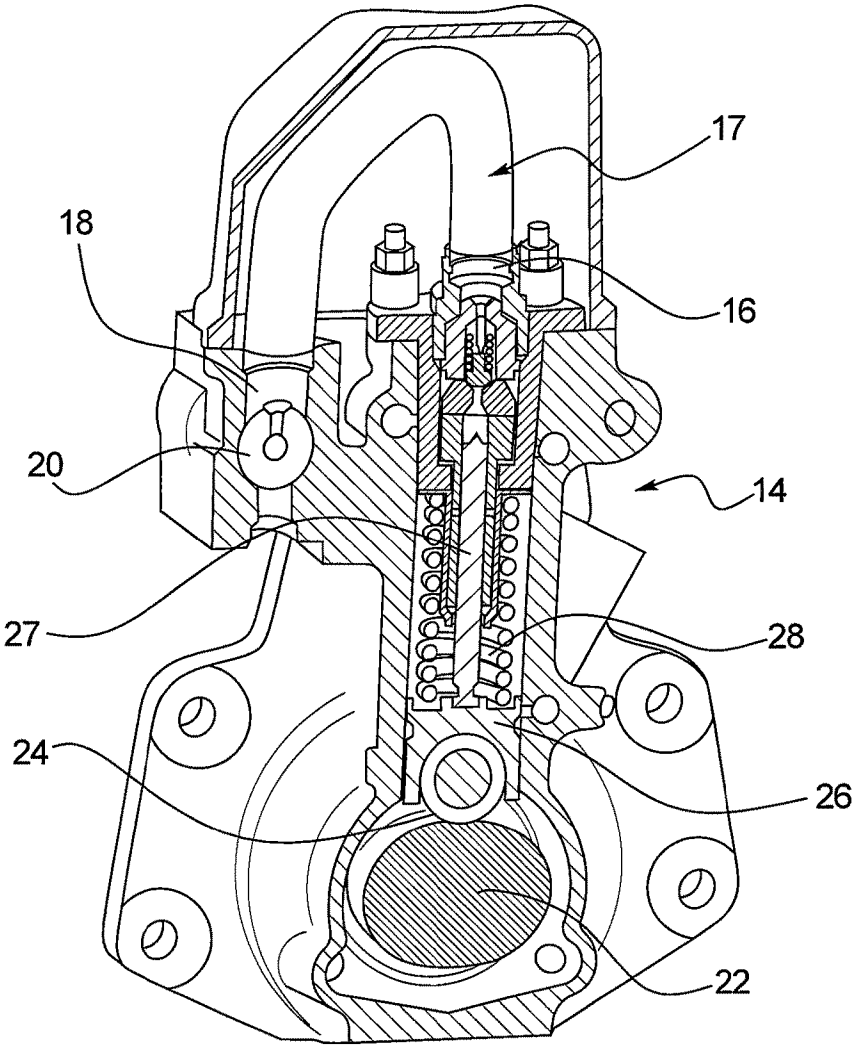
FIG. 2 is an elevational cross-sectional view of a pumping element of the fuel pump of FIG. 1, as viewed along lines 2-2 of FIG. 1.

Referring initially to FIGS. 1 and 2, a variable delivery high-pressure fuel pump 10 incorporates a structural housing 12 which contains a plurality of serially aligned pumping elements 14, only one of which is shown (FIG. 2). Each pumping element may be configured to provide a controlled supply of high-pressure fuel to a discharge port 16 and into jumper lines (shown schematically in FIG. 2). The plurality of pumping elements 14 are each adapted for mechanical communication with an engine driven camshaft. Pumping elements 14 are situated in tandem within the housing 12 for mechanical actuation by a camshaft. The jumper lines transfer the pressurized fuel into an inlet port 18 and then into a fuel pump manifold 20.

Referring now specifically to FIG. 2, an engine driven cam 22 on the aforenoted camshaft may be adapted to mechanically engage a roller-type cam follower 24 to convert rotary motion of the camshaft into reciprocal motion of the pumping element 14. As such, the rotating cam follower 24 may engage a reciprocally moving bearing member 26 to urge fuel plunger piston 27 upwardly against the downward force of spring 28, as shown.

A plurality of plunger pistons 27 are associated with the plurality of pumping elements 14, and each of the plunger pistons may be adapted to be reciprocated simultaneously and in tandem within the housing 12. Moreover, in the described embodiment, each of the plunger pistons 27 is orthogonally positioned relative to each of the pump manifold 20 and fuel rails 32, 34 described below, although alternative configurations and/or geometries may be feasible for use instead. The reciprocal action of the plunger pistons 27 may be effective to cyclically feed high pressure fuel, supplied into the pump 10 via a low pressure inlet metering valve (not shown), into the high-pressure discharge port 16. As will be appreciated by those skilled in the art, pressures at the discharge port 16 may be within a typical operating range of 20 to 300 megapascals (MPa).

Figure 3:
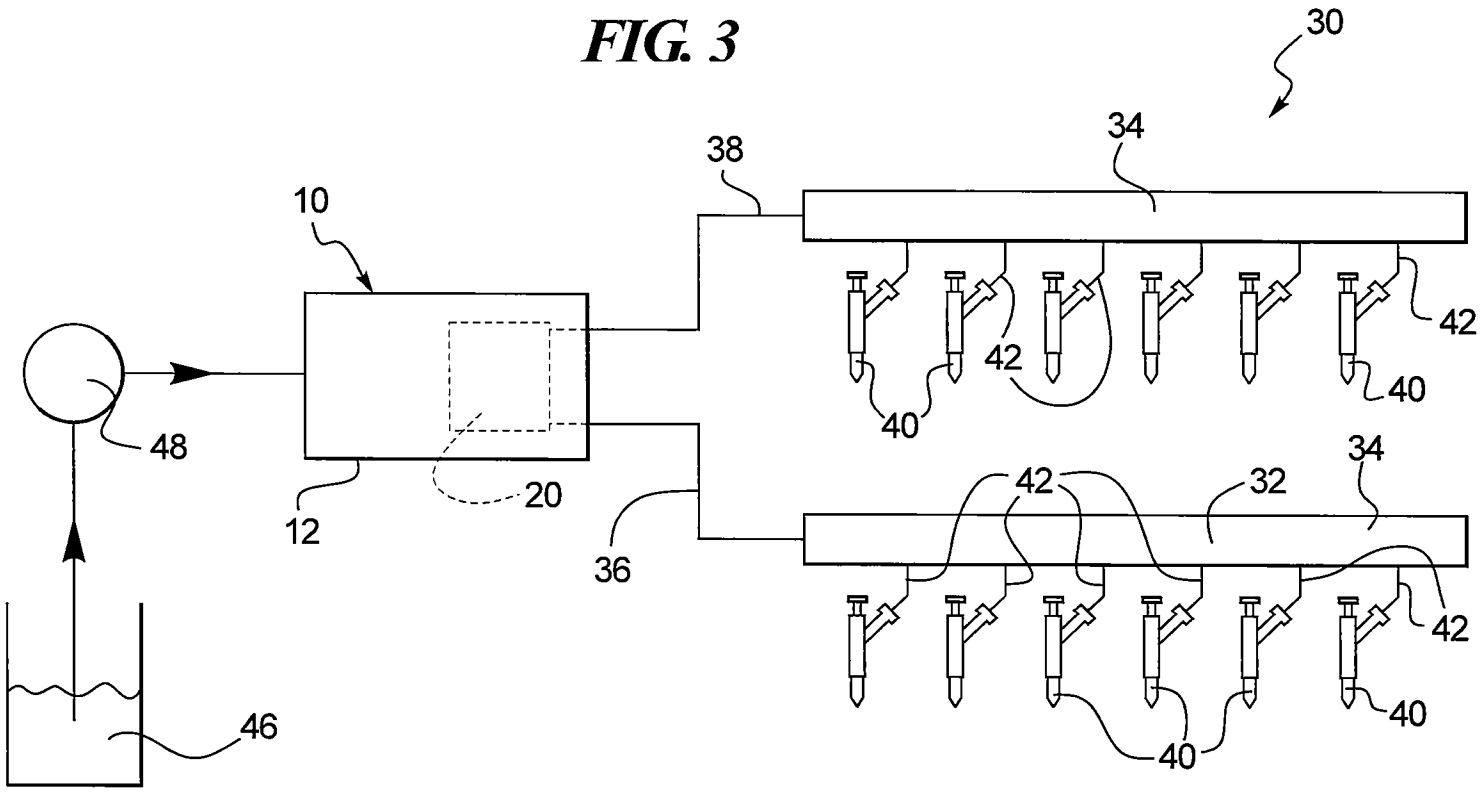
FIG. 3 is a schematic view of a fuel pump manifold and associated fuel rails that may be utilized within the disclosed compact high-pressure fuel pump of FIG. 1.

Referring now to FIG. 3, a high-pressure fuel delivery system 30 is shown schematically. From the pump manifold 20, fuel may be directed into respective left and right fuel rails 32 and 34, by way of respective left and right fuel pump lines or conduits 36 and 38. The fuel travels into injectors 40 (only one of which is shown) by means of a plurality of injection lines 42. The injection lines 42 extend from both left and right rails 32, 34, into each injector 40. In the described embodiment, it may be appreciated that each rail 32, 34 supplies fuel to a bank of eight cylinders, thus to a total of 16 cylinders of a V-16 cylinder engine in the disclosed embodiment, and by way of example only. Each fuel injector 40 is adapted to inject pressurized fuel into an associated combustion chamber (not shown) under predetermined conditions of timing, fuel pressure, and fuel flow rate, in accordance with real-time engine conditions, as will be appreciated by those skilled in the art.

In the described embodiment, the plurality of fuel rails may in some arrangements be replaced by individual canisters or chambers for handling accumulated volumes of fuel prior to actual entry of the fuel into individual injectors. Such chambers or canisters may act as a plurality of fuel injection accumulators, each adapted for supplying pressurized fuel to at least one fuel injector. In such cases, such canisters, chambers, and/or accumulators would be considered equivalent to fuel rails by those skilled in the art, and are so treated herein.

With respect to the specific embodiment of the fuel rails 32, 34 shown and described herein, mounting clamps may be effective to secure the rails within the pump housing 12 of the disclosed embodiment. Alternatively, the structures of the pump manifold 20 and the fuel rails 32, 34, and even fuel pump conduits 36 and 38 may be formed as an interior part of the housing 12, or as separate manifold blocks, or even as individual components bolted to the housing 12. Finally, FIG. 3 also schematically depicts fuel flow from the fuel tank 46 through the low pressure fuel transfer pump 48, and into the high-pressure pump 10.

Figure 4:
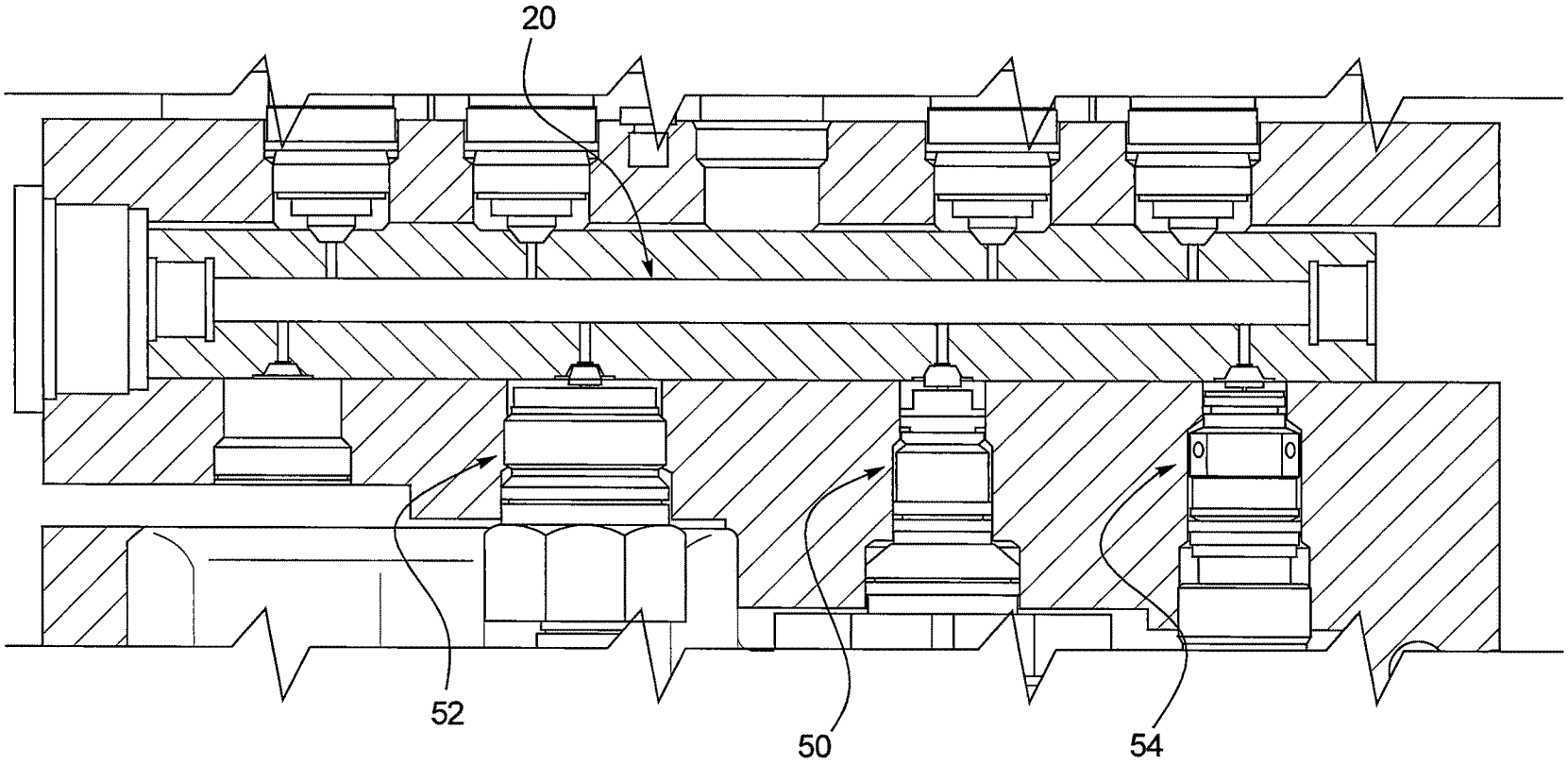
FIG. 4 is an enlarged view of a portion of FIG. 1, depicting the control valve, sensor, and relief valve as disclosed in one disclosed embodiment of the fuel pump.

Referring now to FIG. 4, an enlarged view of specific pump components can be viewed in enhanced detail. A pressure control valve 50, a pressure sensor 52, and a pressure relief valve 54 may be aligned vertically in a parallel array within the housing 12 as shown. Each of the cylindrically shaped units may have a substantially orthogonal orientation relative to the manifold 20 and the fuel rails 32 and 34. As disclosed, the control valve 50, sensor 52, and relief valve 54 may have direct and parallel fluid communication with the pump manifold 20, rather than in-series fluid communication therewith. The pressure control valve 50 is effectively a bleed valve that may be actuated via conventional electronic controller 44 (see FIG. 1) whenever the fuel pressure within the manifold 20 fluctuates above predetermined threshold values or ranges. Thus, such actuation may be effected whenever the pressure becomes exceeds a desirable threshold, and/or upon actual fuel pump or system shutdown. In the described embodiment, the control valve 50 may be effective to limit overshoots to less than 10% of desired threshold pressures.

The pressure sensor 52 may effectively measure and monitor fuel pressure values within the manifold 20, and may generate continuous and/or otherwise appropriate signals to the electronic controller 44 to cause the controller 44 to manipulate the pressure control valve 50 and/or the pump metering valve responsively to fuel pump system pressure fluctuations and in accordance with at least one predetermined algorithm.

The pressure relief valve 54 may be designed to be only hydraulically actuated within the system, i.e., in the sense of not having any electrical connection or communication with the electronic controller 44. The pressure relief valve 54 will act as an ultimate protector of the entire fuel system, and will only open if the system pressure exceeds a target threshold value. In the described embodiment, the relief valve 54 may be designed to open and relieve the fuel radially to return to the fuel tank 46 through drain passages (not shown) whenever system pressure exceeds the maximum nominal threshold pressure by 15%. In addition, for "limp home" capabilities as noted below, the relief valve is designed to remain open until the engine is actually shut down.

Although depicted in a specific arrangement and/or alignment, and having the noted cylindrical shapes, other alignments, orientations, and shapes of the described components may equivalently fall within the spirit and scope of this disclosure.

Figure 5:
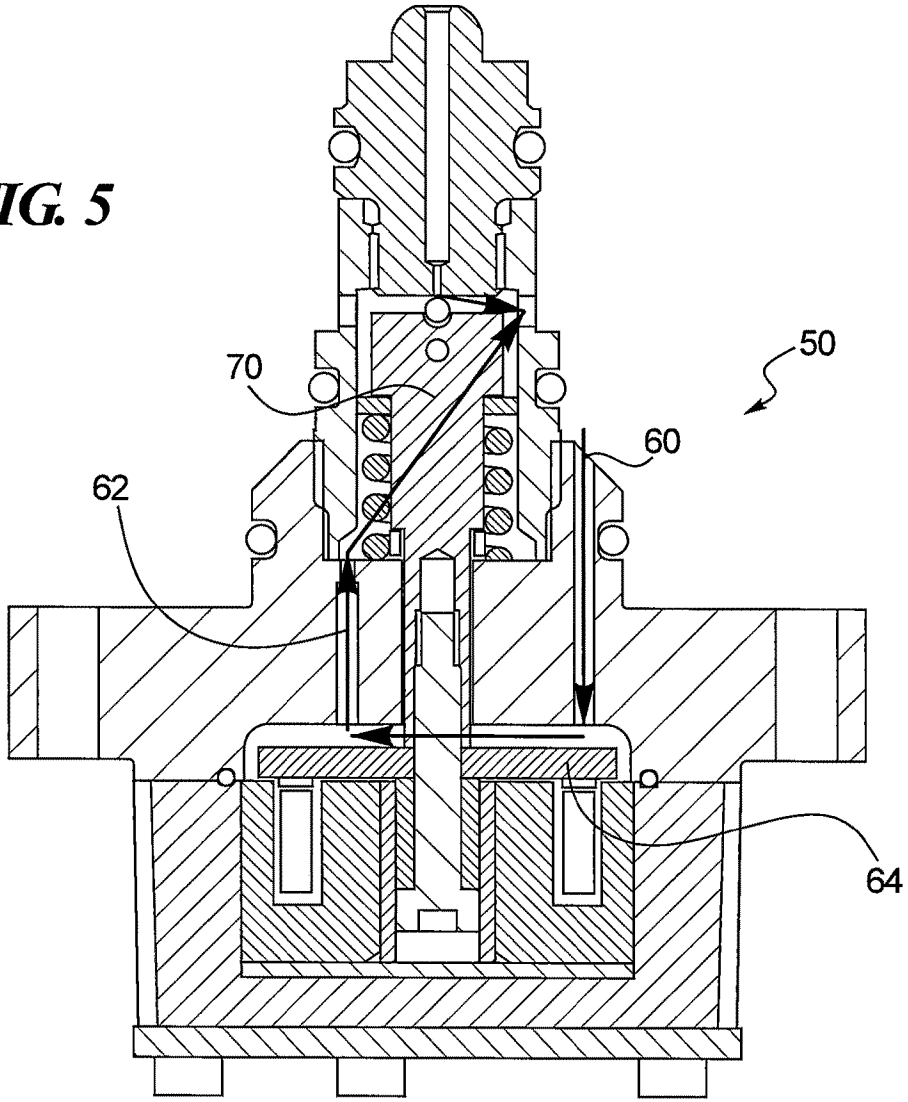
FIG. 5 is an enlarged view of the control valve of FIG. 4 depicting cooling fuel passages for reducing control valve solenoid temperatures.

The high-pressure fuel pump 10 may be designed to incorporate other features for convenience of operability, including a limp-home capability after an event occurs that causes the pressure relief valve 54 to open. In such case, the system may be designed to assure that the pressure never falls below a value wherein the engine will not have at least some minimal operating capability. In addition, to the extent that the pressure control valve 50 may become overheated in its high-pressure fuel environment, a low pressure fuel flow and drain system may accommodate cooling of the pressure control valve 50. Thus, in FIG. 5, the pressure control valve 50 may contain a low pressure bypass cooling fuel circuit 60 defined by apertures 62 within the pump housing 12 (see arrows), that may be effective to reduce control valve operating temperatures by cooling off the control valve actuating solenoid 70. The bypass fuel may then return to a fuel drain 64 as shown to facilitate return of the fuel back to the fuel tank 46.

Finally, the engine with which the high-pressure fuel pump may be associated may be a compression ignition engine of the type most commonly known as a diesel engine.

As disclosed, all of the elements aforedescribed, with the exception of the engine, are hereby defined as a fuel pump manifold pressure control system 100.

INDUSTRIAL APPLICABILITY

The disclosed fuel pump manifold pressure control system 100 may find potential utility for use with internal combustion engines, and particularly to such engines utilizing high-pressure fuel systems, including compression ignition engines, such as diesel engines.

In general, technology disclosed herein may have industrial applicability in a variety of settings such as in a variety of diesel engine settings in which space requirements are particularly limited. The control system 100 may be effective to improve fuel pressure modulation of associated engines by reducing fuel pressure variability associated with divergent placements of control valve, sensor and relief valve units. Industrial applicability of such compact fuel pump units extends to virtually all motorized transport platforms, including automobiles, buses, trucks, tractors, industrial work machines and most off-road machines utilized in agriculture, mining, and construction.

The high pressure pump unit features disclosed herein may be particularly beneficial to wheel loaders and other earth moving, construction, mining or material handling vehicles that may utilize compact fuel pump systems within such fuel pump housings. Such pump unit features may also be particularly beneficial to the previously mentioned marine and industrial applications including petroleum, drilling, and electrical.

What is claimed is:

1. A fuel pump manifold pressure control system comprising:

a housing enclosing a fuel pump manifold, wherein said fuel pump manifold is adapted to supply fuel to a fuel rail, said fuel rail being adapted for supplying pressurized fuel to at least one fuel injector; said fuel pump manifold pressure control system further comprising:

a) a pressure control valve;

b) a pressure sensor, and c) a pressure relief valve;

wherein each of said pressure control valve and pressure sensor is adapted for signal communication with an electronic controller, and for fuel communication with said fuel pump manifold, and wherein said pressure relief valve is adapted for fuel communication with said fuel pump manifold; wherein each of said control valve, sensor, and relief valve is fixedly mounted to, and internally contained within, said housing.

2. The fuel pump manifold pressure control system of claim 1, further comprising a fuel pumping element, wherein said fuel pumping element is in fluid communication with said fuel pump manifold, and wherein said pressure control valve is responsive to fuel pressure fluctuations within said fuel pressure manifold such that said pressure control valve is in signal communication with said electronic controller, and causes said electronic controller to urge said pumping element to take corrective action whenever said fuel pressure in said fuel pressure manifold reaches a value outside of a predetermined target range.

3. The fuel pump manifold pressure control system of claim 2, wherein said pressure relief valve is adapted to open to relieve fuel pressure whenever said fuel pressure in said fuel pressure manifold exceeds a predetermined limit.

4. The fuel pump manifold pressure control system of claim 2, wherein said pressure sensor is in continuous signal communication with said electronic controller to assure that said pumping element functions responsively to said fuel pressure fluctuations within said fuel pressure manifold.

5. The fuel pump manifold pressure control system of claim 2, further comprising at least one accumulated volume of fuel in communication with said pump manifold.

6. The fuel pump manifold pressure control system of claim 5, wherein each of said pressure sensor, control valve, and relief valve is generally cylindrical in shape, and wherein each is physically oriented substantially parallel with respect to the other, and wherein each of said elements shares fuel communication with said manifold in parallel with the other.

7. The fuel pump manifold pressure control system of claim 6, wherein each of said pump manifold and said pump rails are substantially orthogonally positioned relative to each of said pressure sensor, control valve, and relief valve.

8. The fuel pump manifold pressure control system of claim 7, further comprising a plurality of pumping elements adapted for mechanical communication with an engine driven camshaft, each of said pumping elements comprising a spring loaded plunger piston situated therein for reciprocal motion, each plunger piston being oriented parallel to each of said other plunger pistons of said other pumping elements, wherein each of said plunger pistons is adapted to be reciprocated simultaneously and in tandem within said housing by said camshaft.

9. The fuel pump manifold pressure control system of claim 8, wherein said each of said plunger pistons is orthogonally positioned relative to each of said pump manifold and fuel rails.

10. A fuel pump comprising:

a housing, the housing enclosing a) a pressure control valve, b) a pressure sensor, and c) a pressure relief valve;

each of said elements having fluid communication with a fuel pump manifold, each of said pressure control valve and pressure sensor being adapted for signal communication with an electronic controller, wherein each of said elements is internally affixed to and contained within said housing.

11. The fuel pump of claim 10, further comprising at least one accumulated volume of fuel in communication with said pump manifold.

12. The fuel pump of claim 11, wherein each of said pressure sensor, control valve, and relief valve is generally cylindrical in shape, and wherein each is physically oriented substantially parallel with respect to the other, and wherein each of said elements shares fuel communication with said manifold in parallel with the other.

13. The fuel pump of claim 12, wherein each of said pump manifold and said pump rails are substantially orthogonally positioned relative to each of said pressure sensor, control valve, and relief valve.

14. The fuel pump of claim 13, further comprising a plurality of pumping elements adapted for mechanical communication with an engine driven camshaft, each of said pumping elements comprising a spring loaded plunger piston situated therein for reciprocal motion, each plunger piston being oriented parallel to each of said other plunger pistons of said other pumping elements, wherein each of said plunger pistons is adapted to be reciprocated simultaneously and in tandem within said housing by said camshaft.

15. The fuel pump of claim 14, wherein said each of said plunger pistons is orthogonally positioned relative to each of said pump manifold and fuel rails.

16. A compression ignition engine comprising a high-pressure fuel injection pump system, said pump system comprising a pump housing, said pump housing including a fuel pump manifold contained within said housing, said pump housing containing a fuel rail in fluid communication with said fuel manifold, wherein said fuel rail is adapted to supply pressurized fuel to a fuel input site; said housing comprising, as separate elements, each of:

a) a pressure control valve, b) a pressure sensor, and c) a pressure relief valve;

each of said elements having fluid communication with said fuel pump manifold, each of said pressure control valve and pressure sensor being adapted for signal communication with an electronic controller, wherein each of said elements is internally affixed to and contained within said housing.

17. The compression ignition engine of claim 16, wherein said pump housing further comprises a pair of fuel rails in communication with said pump manifold.

18. The compression ignition engine of claim 16, wherein said engine is a diesel engine.

19. The compression ignition engine of claim 16, further comprising at least one accumulated volume of fuel in communication with said pump manifold.

20. The compression ignition engine of claim 16, wherein said engine comprises limp home capabilities after an over-pressure event opens said pressure relief valve.

* * * * *